United States Patent [19]

Yamamoto et al.

[11] 4,099,758

[45] Jul. 11, 1978

[54] CLOSURE CONSTRUCTION HAVING ADJUSTABLE CATCH ASSEMBLY

[75] Inventors: Yukio Yamamoto; Masami Sakashita, both of Kurobe, Japan

[73] Assignee: Yoshida Kogyo, K.K., Tokyo, Japan

[21] Appl. No.: 653,007

[22] Filed: Jan. 28, 1976

[30] Foreign Application Priority Data

Feb. 5, 1975 [JP] Japan ..... 50/17355[U]
Apr. 23, 1975 [JP] Japan ..... 50/55962[U]

[51] Int. Cl.[2] ..... E05C 13/00
[52] U.S. Cl. ..... 292/341.18
[58] Field of Search ..... 292/241, 341.18, 341.19, 292/DIG. 46; 49/449; 16/129

[56] References Cited

U.S. PATENT DOCUMENTS

| | | | |
|---|---|---|---|
| 2,587,547 | 2/1952 | Steingruber | 292/241 X |
| 2,798,754 | 7/1957 | Russell | 292/341.18 |
| 2,814,543 | 11/1957 | Siegel | 292/341.18 X |
| 3,591,247 | 12/1968 | Berry | 16/129 X |

*Primary Examiner*—Richard E. Moore

*Attorney, Agent, or Firm*—Hill, Gross, Simpson, Van Santen, Steadman, Chiara & Simpson

[57] ABSTRACT

An adjustable catch assembly or window lock used with closures such as window sashes having meeting stiles has a cam or rotary crescent rotatably mounted on one of the meeting stiles and a cam keeper secured to the other meeting stile. The cam is rotated into engagement with the cam keeper to retain the closures in closed position. The cam keeper has means for adjusting and fixing the relative distance between a hook or keeper detent of the cam keeper and the stile to which the cam keeper is secured in order to compensate for disengagement or misalignment of the keeper detent or hook from a cam surface of the cam secured to the other meeting stile. The fixing means comprises either of a plurality of equally spaced-apart recesses formed transversely in or an elongated projection formed transversely on the cam keeper, and either of a rib or ribs formed longitudinally on or a plurality of equally spaced-apart grooves formed longitudinally in the keeper-carrying meeting stile. A selected one of the recesses in or the projection on the cam keeper is engageable with the rib or ribs on or selected one of the grooves in the meeting stile.

10 Claims, 8 Drawing Figures

CLOSURE CONSTRUCTION HAVING ADJUSTABLE CATCH ASSEMBLY

BACKGROUND OF THE INVENTION

1. Field of the Invention

This invention relates to a closure construction having a window lock or catch assembly, and more specifically to one having an adjustable cam keeper secured to the meeting stile of one of the window sashes, panel closures or the like.

2. Prior Art

Catch assemblies to which the invention pertains are of the type having a cam or rotary crescent rotatably mounted on one of the meeting stiles and a cam keeper secured to the other meeting stile, the cam being adapted for rotation into engagement with the cam keeper to retain the sashes in closed position. The cam keeper is usually adjustable relative to the stile for compensating for disengagement or misalignment of the cam keeper from the cam, the disengagement or misalignment being due primarily to manufacturing tolerances of the window sash frame members and the catch assembly components.

One typical adjustable cam keeper comprises an elongated plate member having at one end a cam detent engageable with an arcuate cam, having at its longitudinal edges a plurality of cut-away recesses, and having an elongated central aperture intermediate the recessed edges. The plate member is secured to the meeting stile by a screw threaded through the central aperture into the meeting stile with a retaining member interposed between the screw and the plate member and having prongs engageable with the cut-away recesses and having projections engageable with an edge of the meeting stile. The plate member extends adjustably in a direction normal to the longitudinal axis of the meeting stile. However, this type of adjustable cam keeper requires high precision in its attachment and adjustment relative to the stile since, if and when the retaining member fails to engage snugly with the cam plate member, the retaining member and the screw project into the path of travel of the other sash and tend to collide against the other meeting stile when the sashes are moved to open or close the window, and smooth relative movement between the sashes fails to be achieved, and the stiles and the cam keeper are prone to become damaged. Another difficulty attendant with the prior adjustable cam keeper is that manufacturing and attaching the retaining member involves additional time, cost and trouble.

SUMMARY OF THE INVENTION

It is a principle object of the present invention to provide a closure construction including catch assembly having an adjustable cam keeper which can be attached to the meeting stile with maximum ease and be held stably in position.

Another object of the invention is the provision of an adjustable cam keeper which will facilitate its adjustment relative to the meeting stile.

Still another object of the invention is to provide an adjustable cam keeper which is simple in structure and is prevented from interfering with the other meeting stile.

In accordance with the invention, there is provided a closure construction having an adjustable catch assembly with means for adjusting and fixing the relative distance between a keeper detent or hook of a cam keeper and the one of the meeting stiles to which the cam keeper is secured in order to compensate for disengagement or misalignment of the keeper detent or hook with respect to a cam surface of a cam assembly secured to the other meeting stile. The means comprises either of a plurality of equally spaced-apart recesses formed transversely in or an elongated projection formed transversely on the cam keeper, and either of a rib or ribs formed longitudinally on or a plurality of equally spaced-apart grooves formed longitudinally in the first-named one of the meeting stiles. Selected one of the recesses in or the projection on the cam keeper are receptive of the rib or ribs on or selected ones of the grooves in the meeting stile.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
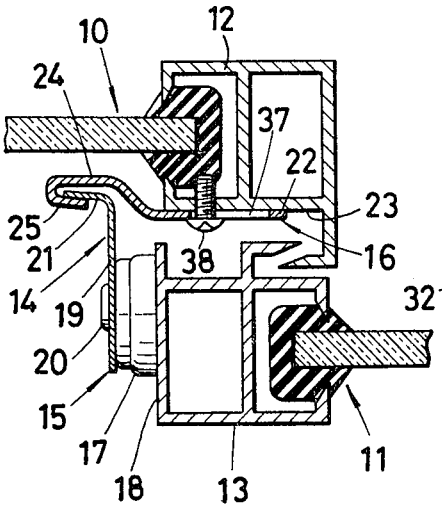
FIG. 1 is a horizontal cross-sectional view of an adjustable catch assembly attached to a pair of dual window sashes constructed in accordance with the present invention.

The present invention is particularly useful when used with a pair of relatively movable window sashes 10, 11 such as partly shown in FIG. 1. The window sashes 10, 11 are mounted within a fixed frame (not shown) in parallel closely spaced planes, and include a pair of stiles 12, 13, respectively, which come together or meet in overlapped relation to each other when the window sashes 10, 11 are closed completely. Thus the stiles 12, 13 are referred to herein as meeting stiles.

Figure 2:
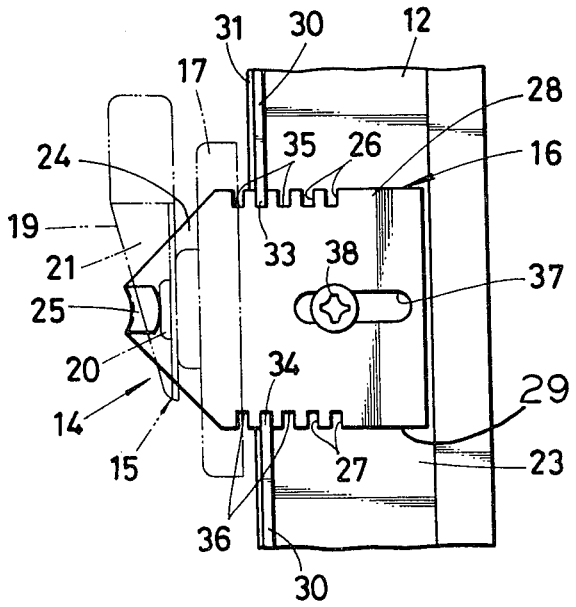
FIG. 2 is a front elevational view of an adjustable cam keeper of the catch assembly of FIG. 1 attached to one of the meeting sash stiles with the other meeting stile omitted and a catch cam of the catch assembly shown in phantom for clarity of illustration.

In FIGS. 1 and 2, an adjustable catch assembly 14 is attached to the meeting stiles 12, 13. The adjustable catch assembly 14 generally comprises a cam assembly 15 secured to the meeting stile 13 and a cam keeper 16 adjustably secured to the meeting stile 12. The cam assembly 15 comprises a base portion 17 fixedly mounted on a stile wall 18 extending normal to the general plane of the sash 11, and a catch cam or rotary crescent 19 rotatably secured to the base portion 17 by a pivot means 20 such as a double-headed rivet. The catch cam 19 includes an arcuate cam surface 21 for coacting with the cam keeper 16 to retain the window sashes 10, 11 in locked relation as shown in FIG. 1.

The cam keeper 16 is made of sheet metal and includes a body portion 22 secured to a stile wall 23 which extends along the general plane of the sash 10 and faces toward the stile 13. The body portion 22 has an extension 24 of a triangular shape extending therefrom and in offset relation thereto and terminating in an integral hook or catch detent 25 which is directed toward the body portion 22. The body portion 22 is further provided with means for adjusting the relative distance between the stile 12 and the hook or keeper detent 25 so as to facilitate adjustment of the position of the cam keeper 16 to compensate for disengagement or misalignment of the hook or keeper detent 25 from the cam surface 21 of the cam assembly 15.

As best shown in FIG. 2, the adjustment means for the keeper 16 comprises a pair of upper and lower groups of notches or recesses 26, 27 formed in a pair of parallel longitudinal marginal edges 28, 29, respectively. The recesses in each group are equally spaced from each other. Each of the recesses 26 is located so as to register transversely with one of the corresponding recesses 27.

An elongated rib 30 is formed integrally with the wall 23 of the stile 12 at a position adjacent to a longitudinal edge 31 of the stile wall 23 beyond which the extension 24 extends away from the stile 12. The rib 30 extends longitudinally of the stile 12 and is interrupted to provide a cutout 32 (FIG. 3) at a position where the cam keeper 16 is to be attached to the stile 12. The interrupted rib 30 provides a pair of upper and lower rib ends 33, 34 which are receivable in a selected pair of aligned recesses 26, 27, respectively. The distance between the rib ends 33, 34 should be such that they, when fitted in the selected recess pair, abut snugly against the closed ends 35, 36 of the recesses 26, 27, respectively.

An oblong aperture 37 is provided in the cam keeper body 22 intermediate the longitudinal marginal edges 28, 29 and extends in the longitudinal direction of the cam keeper assembly 16.

Figure 3:
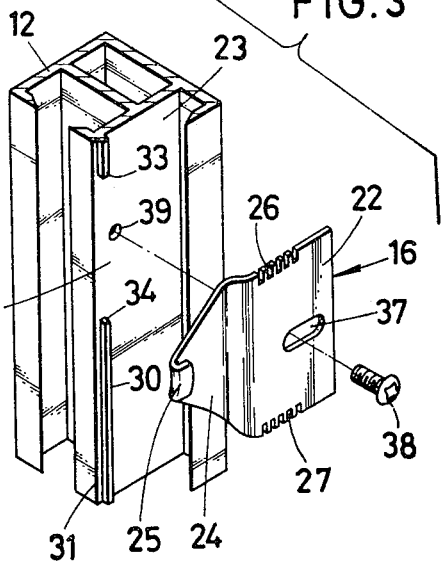
FIG. 3 is an exploded perspective view showing the way the cam keeper is attached to the meeting stile.

When the cam keeper 16 is to be installed, its position is adjusted relatively to the stile 12 so as to determine the extent of projection of the hook or cam detent 25 from the stile 12, and it is held in position on the stile wall 23 with the rib ends 33, 34 received in a selected pair of recesses 26, 27, respectively. As shown in FIGS. 2 and 3, the cam keeper 16 is secured to the meeting stile 12 by a screw 38 extending through the aperture 37 into a tapped hole 39 formed through the stile wall 23.

Figure 5:
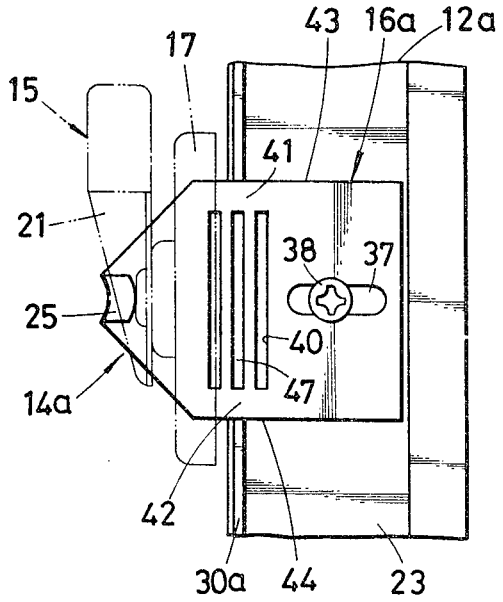
FIG. 5 is a front elevational view of an adjustable cam keeper of the catch assembly shown in FIG. 4.
Figure 4:
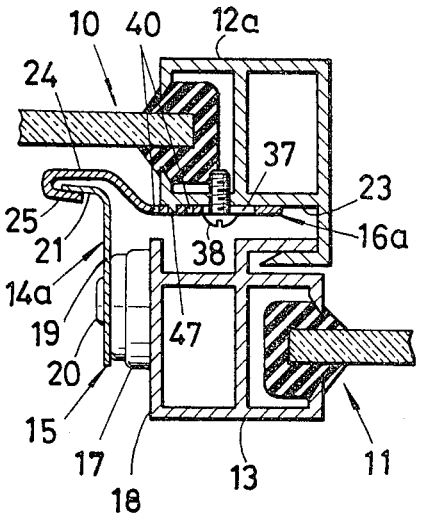
FIG. 4 is a view similar to FIG. 1 but showing an adjustable catch assembly according to a second embodiment of the invention.
Figure 6:
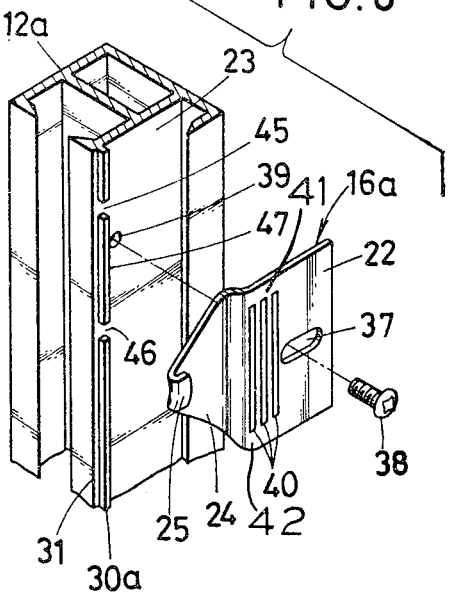
FIG. 6 is an exploded perspective view showing the way the cam keeper of FIG. 5 is attached to the stile.

FIGS. 4 through 6 show a cam keeper **16*a* constructed according to a second embodiment of the present invention. For adjustable mounting of the cam keeper 16*a*, there is a plurality of equally spaced-apart slits 40 formed transversely therein adjacent to the triangular extension 24. A pair of upper and lower marginal portions 41, 42 lie between the slits 40 and an upper edge 43, and between the slits 40 and a lower edge 44, respectively. An elongated rib 30*a* is cut away to provide a pair of upper and lower cutouts 45, 46 and an island rib 47 which is complemental to each of the slits 40. The upper and lower cutouts 45, 46 are so dimensioned as to receive snugly therein the upper and lower marginal portions 41, 42**, respectively.

For installation of the cam keeper **16*a*, one of the vertical slits 40 is selected for reception of the island rib 47 in order to adjust the extent of projection of the cam keeper detent 25*a* from the meeting stile 12*a*. The cam keeper 16*a* is held in position on the stile 12*a* with the upper and lower marginal portions 41, 42 fitted in the upper and lower cutouts 45, 46, respectively, and the selected slit 40 fitted over the island rib 47. The cam keeper 16*a* is secured to the meeting stile 12*a* by the screw 38** in the same manner as in the first embodiment.

Figure 8:
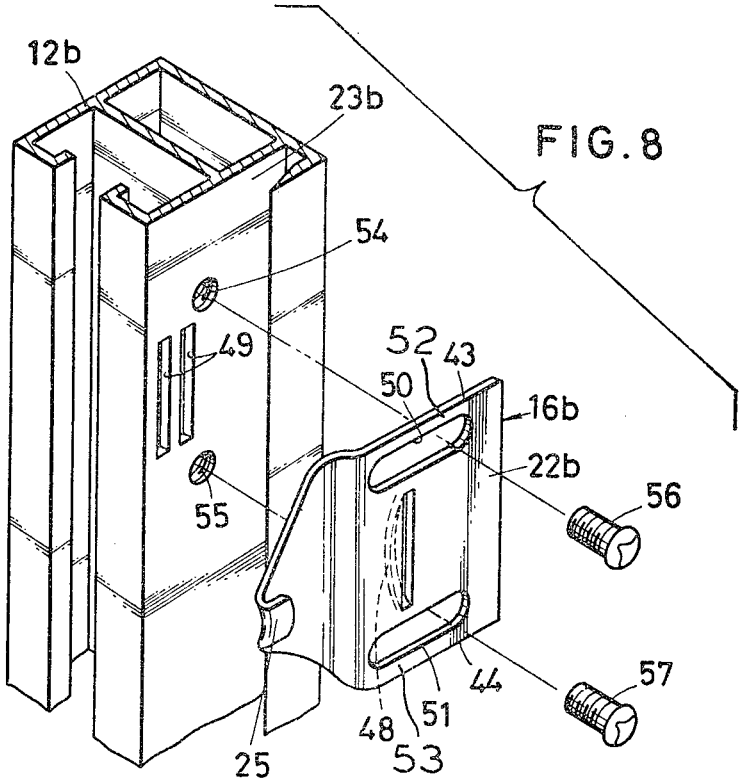
FIG. 8 is an exploded perspective view showing a cam keeper of the catch assembly of FIG. 7, just before it is attached to the stile.
Figure 7:
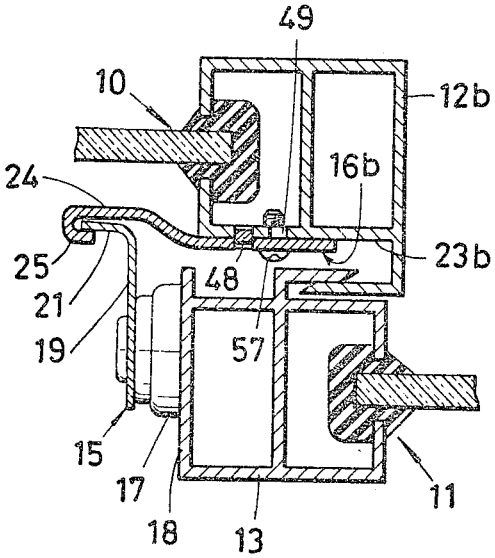
FIG. 7 is a view similar to FIGS. 1 and 4 but showing an adjustable catch assembly of a third embodiment of the invention.

According to a third embodiment shown in FIGS. 7 and 8, a cam keeper **16*b* has keeper location adjustment means comprising a transverse indented formation 48 which is drawn out of the plane of the keeper body portion 22*b* toward the stile 12*b*. The meeting stile 12*b* is provided with a pair of grooves 49 formed in and extending longitudinally of the stile 12*b* and adapted for reception of the formation 48. A pair of horizontally extending oblong apertures 50, 51 extend through the keeper body portion 22*b* adjacent to a pair of marginal portions 52, 53 lying between the formation 48 and the upper edge 43 and between the formation 48 and the lower edge 44, respectively. A pair of tapped holes 54, 55 for receiving a pair of screws 56, 57 are formed in the stile wall 23*b* in registration with the oblong apertures 50, 51, respectively, of the cam keeper 16*b*** when the latter is installed.

For assemblage, the cam keeper **16*b* is held in place on the stile wall 23*b* with the indented formation 48 inserted in selected one of the grooves 49 to thereby adjust the position of the cam keeper 16*b* relative to the stile 12*b* with a view to bringing the keeper detent or hook 25 into effective engagement with the cam surface 21 when the catch cam 19 is rotated to lock the sashes 10, 11 in closed position. Then, the cam keeper 16*b* is fixed to the meeting stile 12*b* by the screws 56, 57 inserted in the tapped holes 54, 55 through the oblong apertures 50, 51**, respectively.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A closure construction having an adjustable catch assembly for retaining the closure construction in a closed position, comprising:

(a) a pair of relatively movable closures each having a meeting stile;

(b) a cam assembly having a base secured to one of said meeting stiles and a cam rotatably mounted on said base and including a cam surface;

(c) a cam keeper having a body portion, an extension extending from said body portion and terminating in a keeper detent, said detent being directed toward said one meeting stile and engageable by said cam surface, said body portion having an oblong aperture elongated in the direction of closure movement;

(d) fastening means extending through said oblong aperture and adjustably securing said cam keeper to the other meeting stile; and (e) interfitting means on said body portion of said cam keeper and on said other meeting stile for positively fixing their relative position in said direction of closure movement and extending transversely to said direction, said interfitting means being a plurality of equally spaced-apart recesses defined in each of the longitudinal edges of said body portion of the cam keeper, and a pair of projections formed integrally with said other stile and received in a selected pair of said cut-away recesses in the longitudinal edges.

2. A closure construction having an adjustable catch assembly for retaining a closure construction in a closed position, comprising:

(a) a pair of relatively movable closures each having a meeting stile;

(b) a cam assembly having a base secured to one of said meeting stiles and a cam rotatably mounted on said base and including a cam surface;

(c) a cam keeper having a body portion, an extension extending from said body portion and terminating in a keeper detent, said detent being directed toward said one meeting stile and engageable by said cam surface, said body portion having an oblong aperture elongated in the direction of closure movement;

(d) fastening means extending through said oblong aperture and adjustably securing said cam keeper to the other meeting stile; and (e) interfitting means on said body portion of said cam keeper, and on said other meeting stile for positively fixing their relative position in said direction of closure movement, and extending transversely to said direction, said interfitting means having a plurality of transverse slits defined in said body portion of said cam keeper, and an elongated projection formed integrally with said other stile and received in a selected one of said slits.

3. A closure construction having an adjustable catch assembly for retaining the closure construction in a closed position, comprising:

(a) a pair of relatively movable closures each having a meeting stile;

(b) a cam assembly having a base secured to one of said meeting stiles and a cam rotatably mounted on said base and including a cam surface;

(c) a cam keeper having a body portion, an extension extending from said body portion and terminating in a keeper detent, said detent being directed toward said one meeting stile and engageable by said cam surface, said body portion having an oblong aperture elongated in the direction of closure movement;

(d) fastening means extending through said oblong aperture and adjustably securing said cam keeper to the other meeting stile; and (e) interfitting means on said body portion of said cam keeper and on said other meeting stile for positively fixing their relative position in said direction of closure movement, and extending transversely to said direction, said interfitting means having an indented formation extending out of the plane of said keeper body portion toward said other stile and extending transversely of said cam keeper, and a plurality of grooves formed in and extending longitudinally of said other stile, said indented formation being received in a selected one of said grooves.

4. A closure construction having an adjustable catch assembly for retaining the closure construction in a closed position, comprising:

(a) a pair of relatively movable closures each having a meeting stile, such stiles having sides that confront each other when the closure construction is closed;

(b) a cam assembly having a base secured to one of said meeting stiles and a cam rotatably mounted on said base and including a cam surface;

(c) a one-piece cam keeper having a body portion engaging said side of the other of said meeting stiles, and an extension extending from said body portion and terminating in a keeper detent, said detent being directed toward said one meeting stile and engageable by said cam surface, said body portion having an oblong aperture elongated in the direction of closure movement;

(d) first interfitting means integral with said body portion of said cam keeper;

(e) second interfitting means integral with said side of said other meeting stile;

(f) one of said interfitting means being a recess, and the other of said interfitting means projecting perpendicularly to said sides and into said recess in meshing relation for positively fixing their relative position in said direction of closure movement, both said interfitting means extending transversely to the length of said oblong aperture; and (g) fastening means extending through said oblong aperture and holding said cam keeper against said other meeting stile, and maintaining said interfitting means in mesh.

5. A closure construction according to claim 1 in which said recesses in one of the longitudinal edges are in transverse registration with the corresponding recesses in the other longitudinal edge, said projections registering with each other in the longitudinal direction of said other stile.

6. A closure construction according to claim 5 in which said projections are formed adjacent to a longitudinal edge of said other stile beyond which said keeper detent extends away from said other stile.

7. A closure construction according to claim 2, said transverse slits being equally spaced apart from each other.

8. A closure construction according to claim 2, said elongated projection being disposed adjacent to a longitudinal edge of said other stile beyond which said keeper detent extends away from said other stile.

9. A closure construction according to claim 3, said grooves being equally spaced from each other.

10. A closure construction according to claim 4 in which said fastening means comprises a screw.

* * * * *